US008152329B2

(12) United States Patent
Liao

(10) Patent No.: US 8,152,329 B2
(45) Date of Patent: Apr. 10, 2012

(54) SOLAR TABLE LAMP AND SOLAR FLASHLIGHT COMBINATION

(75) Inventor: Sung-Yie Liao, Taichung (TW)

(73) Assignee: Chuan Cheng Hat Co., Ltd., Taichung (TW)

( * ) Notice: Subject to any disclaimer, the term of this patent is extended or adjusted under 35 U.S.C. 154(b) by 333 days.

(21) Appl. No.: 12/499,825

(22) Filed: Jul. 9, 2009

(65) Prior Publication Data

US 2011/0007497 A1 Jan. 13, 2011

(51) Int. Cl.
*F21L 4/04* (2006.01)
*F21S 4/00* (2006.01)

(52) U.S. Cl. ..... 362/199; 362/200; 362/249.03; 362/249.1

(58) Field of Classification Search ..... 362/199–200, 362/249.01–249.03, 249.1
See application file for complete search history.

(56) References Cited

U.S. PATENT DOCUMENTS 5,217,296 A * 6/1993 Tanner et al. ..... 362/183
6,953,260 B1 * 10/2005 Allen ..... 362/194
2010/0033960 A1 * 2/2010 Levine ..... 362/198

* cited by examiner

*Primary Examiner* — Diane Lee
*Assistant Examiner* — Sean Gramling

(57) ABSTRACT

A solar table lamp and solar flashlight combination includes a pivotal parallelepiped electricity generation and storage assembly including two solar cell panels mounted thereon, an internal circuit board, and a rechargeable battery. Electricity generated by the solar cell panels is supplied to the rechargeable battery for charging via the circuit board, and the circuit board can control on or off of the charging of the rechargeable battery. A pivotal parallelepiped illumination assembly includes a light source mounted on a front end, and a switch mounted thereon. Two links each include a first pivot pivotably connected to a midpoint of either side of the illumination assembly and a second pivot pivotably connected to a rear end of either side of the electricity generation and storage assembly.

3 Claims, 7 Drawing Sheets

SOLAR TABLE LAMP AND SOLAR FLASHLIGHT COMBINATION

BACKGROUND OF THE INVENTION

1. Field of Invention

The invention relates to solar illumination devices and more particularly to such a solar illumination device capable of manipulatively operating as a table lamp, a flashlight, or a lamp for meeting.

2. Description of Related Art

As shown in FIG. 7, a conventional solar illumination device 50 includes a lamp base 51, a rechargeable unit 52, a lamp head 53 and a solar panel 54. The rechargeable unit is mounted in the lamp base 51. The lamp head 53 is mounted on the lamp base 51. The lamp head 53 is electrically connected to the rechargeable unit 52. The solar panel 54 is electrically connected to the rechargeable unit 52.

The rechargeable unit 52 has a plurality of battery troughs and a plurality of Nickel-Metal Hydride batteries (Ni-H batteries) mounted in the battery troughs. The solar panel 54 is mounted on the lamp base 51 and can absorb solar energy and convert it to electrical energy to supply the rechargeable unit 52 and to be stored in the rechargeable unit 52.

Therefore, it can effectively save energy instead of consuming energy supplied from a common power source. However, the conventional solar illumination device 50 only has the function of the desk lamp. It cannot satisfy the diverse needs of modern people, and many problems still exist such as being relatively bulky, etc.

SUMMARY OF THE INVENTION

It is therefore one object of the invention to provide a solar illumination device capable of manipulatively operating as a table lamp, a flashlight, or a lamp for meeting.

To achieve the above and other objects, the invention provides a solar illumination device comprising a pivotal parallelepiped electricity generation and storage assembly comprising at least one solar cell panel mounted thereon, an internal circuit board, and a rechargeable battery, Electricity generated by the at least one solar cell panel is supplied to the rechargeable battery for charging via the circuit board, and the circuit board can control on or off of the charging of the rechargeable battery. A pivotal parallelepiped illumination assembly includes a light source mounted on a front end and a switch mounted thereon. The switch is adapted to manually press to either connect the rechargeable battery to the light source via the circuit board or disconnect the rechargeable battery from the light source via the circuit board. Two links each includes a first pivot pivotably connected to a predetermined position of either side of the illumination assembly and a second pivot pivotably connected to a predetermined position of either side of the electricity generation and storage assembly. The illumination assembly further comprises two first pivot side surfaces. The electricity generation and storage assembly further comprises two second pivot side surfaces. A first length is defined as a distance between each second pivot and one end of each second pivot side surface. A second length is defined as a distance between each first pivot and two ends of each first pivot side surface. Two pivot points of each link are respectively mounted on the first pivot and the second pivot. A distance between the two pivots of each link is greater than a total length of the first length plus the second length. The electricity generation and storage assembly can clockwise or counterclockwise pivot about the second pivots freely, and the illumination assembly can clockwise or counterclockwise pivot about the first pivots freely.

The above and other objects, features and advantages of the invention will become apparent from the following detailed description taken with the accompanying drawings.

DETAILED DESCRIPTION OF THE INVENTION

Figure 1:
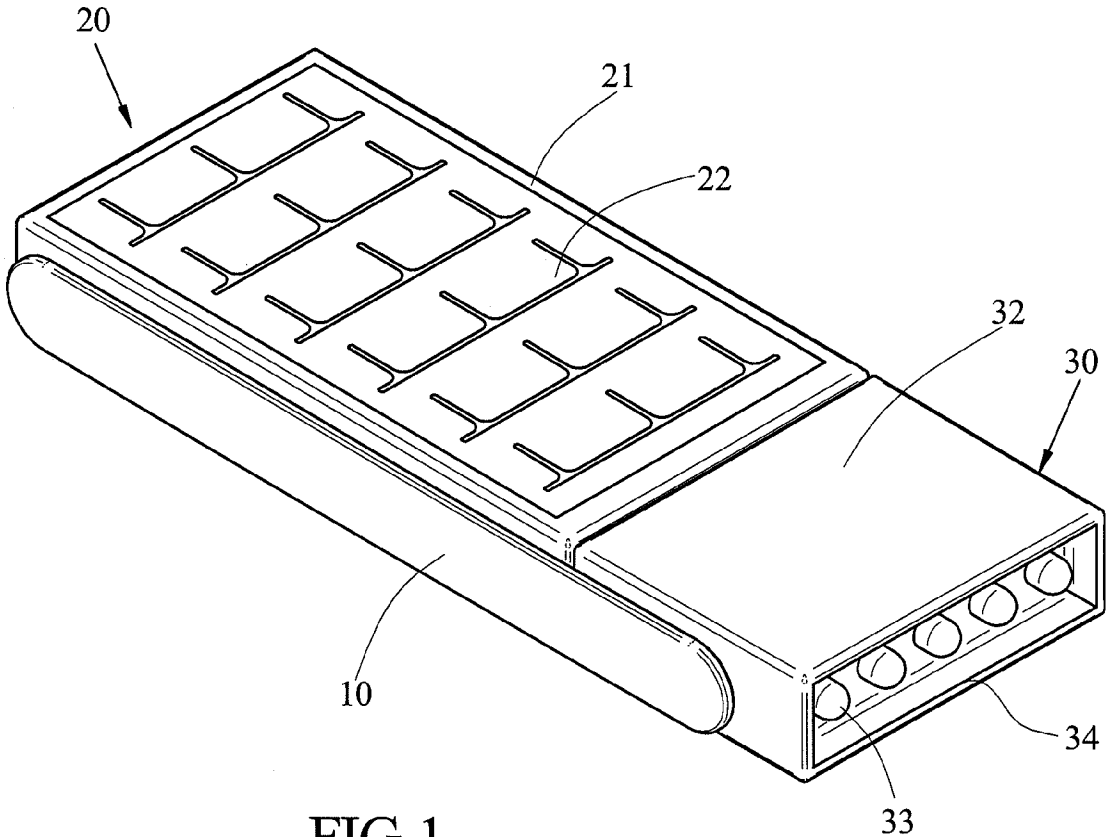
FIG. 1 is a perspective view showing a solar illumination device according to the invention.

Referring to FIGS. 1 to 6, a parallelepiped solar illumination device in accordance with a preferred embodiment of the invention comprises the following components as discussed in detail below.

Two links 10 are elongated, flat. The link 10 comprises a first pivot 12 at a front end and a second pivot 13 at a rear end.

A pivotal electricity generation and storage assembly 20 comprises a parallelepiped main body 21, a solar cell panel 22 on each of top and bottom surfaces of the main body 21, a circuit board 23 in the main body 21, and a rechargeable battery 24 in the main body 21. The solar cell panel 22 can convert light directly into electricity by photovoltaic effect. The electricity is stored in the rechargeable battery 24 via the circuit board 23. The circuit board 23 can control on or off of the charging of the rechargeable battery 24.

A pivotal illumination assembly 30 comprises a parallelepiped housing 32, a push button type switch 31 on a bottom surface of the housing 32, a rectangular flange 34 on a front end of the housing 32, and a plurality of (five are shown) LEDs (light-emitting diodes) 33 transversely provided on a recess (not numbered) defined by the flange 34. The switch 31 is electrically interconnected to the LEDs 33 and the rechargeable battery 24 via electric wires 11 through the links 10 and the circuit board 23 for turning on or off of the LEDs 33. That is, for example, pressing the switch 31 can cause the rechargeable battery 24 to supply current to the LEDs 33 for illumination, and a next pressing of the switch 31 can cause the circuit board 23 to cut the power supply from the rechargeable battery 24 to the LEDs 33.

The first pivots 12 are pivotably connected to both sides of midpoints of the housing 32 respectively. The second pivots 13 are pivotably connected to both sides of a rear end of the main body 21 respectively. The illumination device can be used as a flashlight when both the pivotal illumination assembly 30 and the electricity generation and storage assembly 20 pivot to be close to each other (see FIGS. 1 and 3).

Figure 2:
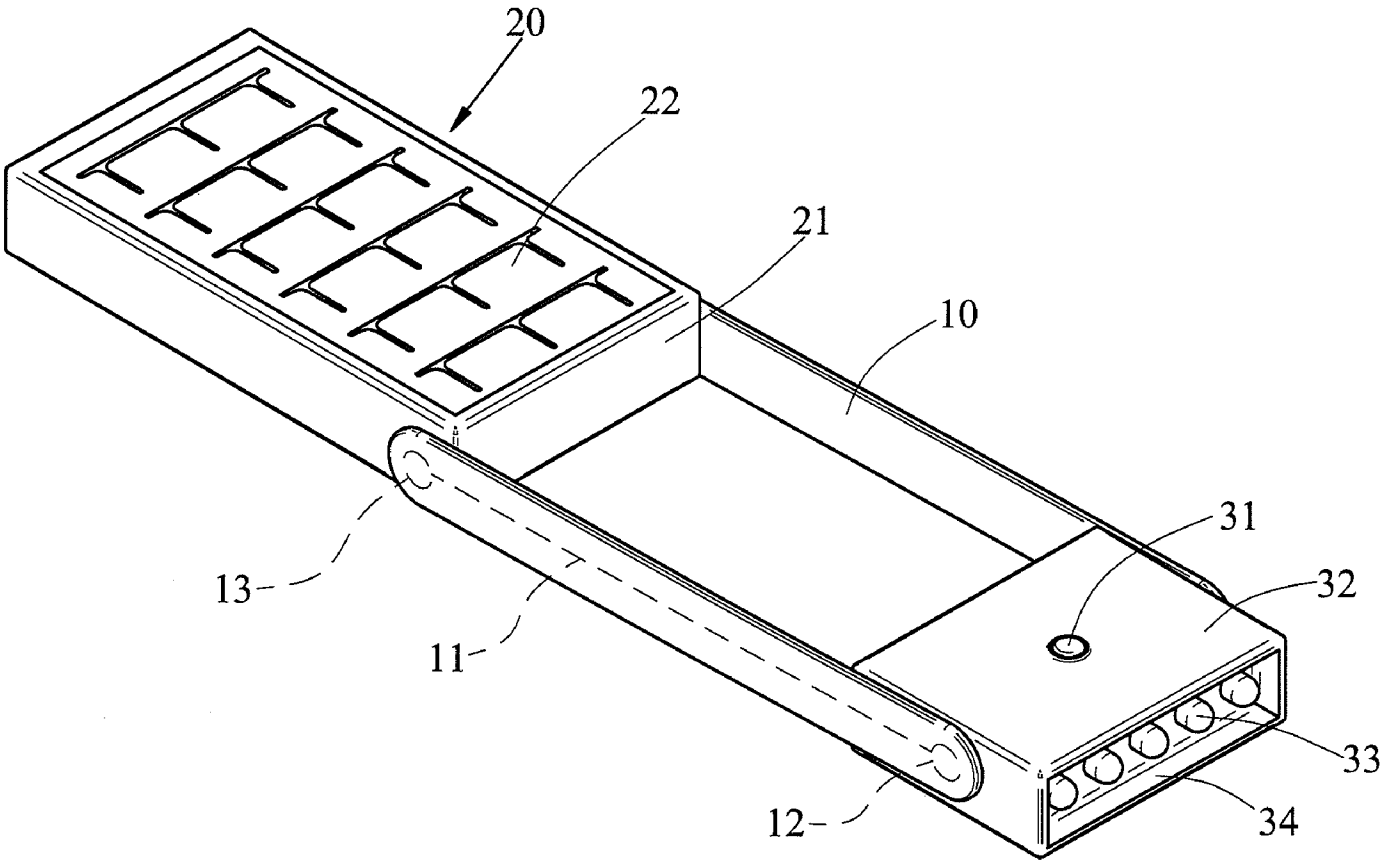
FIG. 2 is another perspective view of the solar illumination device after pivoting both the electricity generation and storage assembly and the solar illumination device about 180 degrees.
Figure 3:
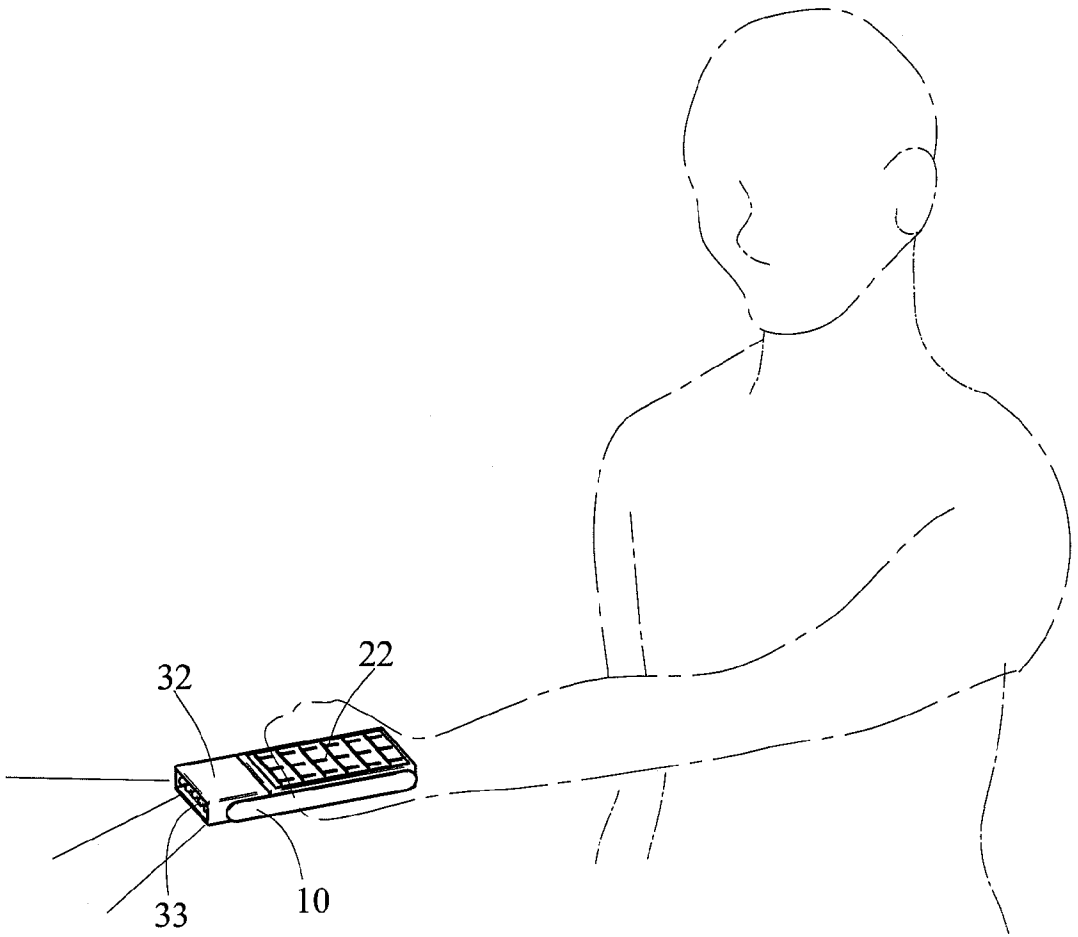
FIG. 3 is an environmental view showing the solar illumination device serving as a flashlight according to the invention.

The length of the link 10 is slightly greater than a length of the main body 21 (i.e., about a distance from front end to rear end of the main body 21) plus one half length of the housing 32 (i.e., from the rear end to the midpoint of the housing 32) so that each of the illumination assembly 30 and the electricity generation and storage assembly 20 can pivot freely without being interfered (see FIG. 2). Moreover, the illumination assembly 30 further comprises two first pivot side surfaces, and the electricity generation and storage assembly 20 further comprises two second pivot side surfaces. A first length is defined as a distance between each second pivot 13 and one end of each second pivot side surface. A second length is defined as a distance between each first pivot 12 and two ends of each first pivot side surface. Two pivot points of each link 10 are respectively mounted on the first pivot 12 and the second pivot 13. A distance between the two pivots of each link 10 is greater than a total length of the first length plus the second length so that each of the illumination assembly 30 and the electricity generation and storage assembly 20 can pivot freely without being interfered (see FIG. 2). In detail, the electricity generation and storage assembly 20 can pivot 360 degrees about the second pivots 13 about the rear end thereof (see FIGS. 4 and 5). The illumination assembly 30 can turn about 360 degrees by pivoting the first pivots 12 about the midpoints thereof (see FIGS. 4, 5 and 6).

Figure 4:
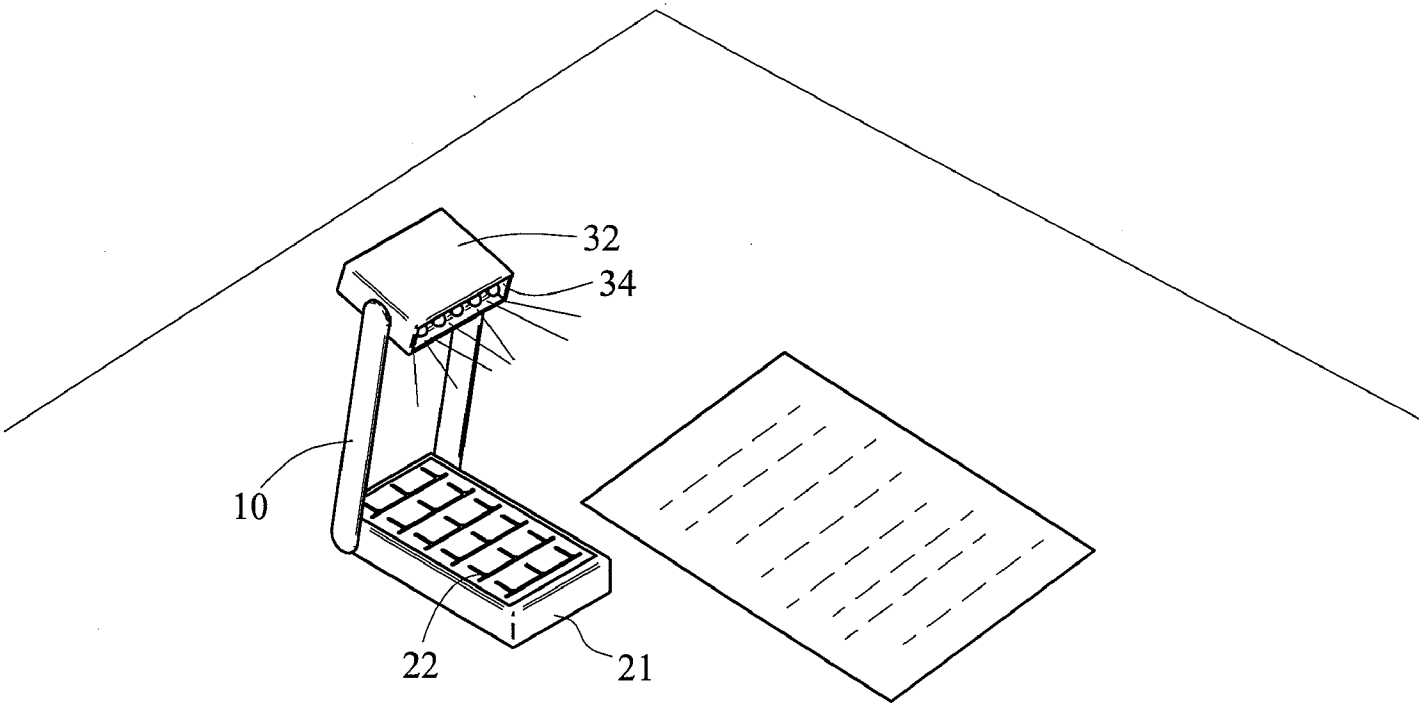
FIG. 4 is an environmental view showing the solar illumination device serving as a table lamp according to the invention.

The illumination device can be used as a table lamp for reading by turning the electricity generation and storage assembly 20 about 80 degrees by pivoting the second pivots 13 about the rear end thereof and turning the illumination assembly 30 to an appropriate angle with respect to a table top (see FIG. 4).

Figure 5:
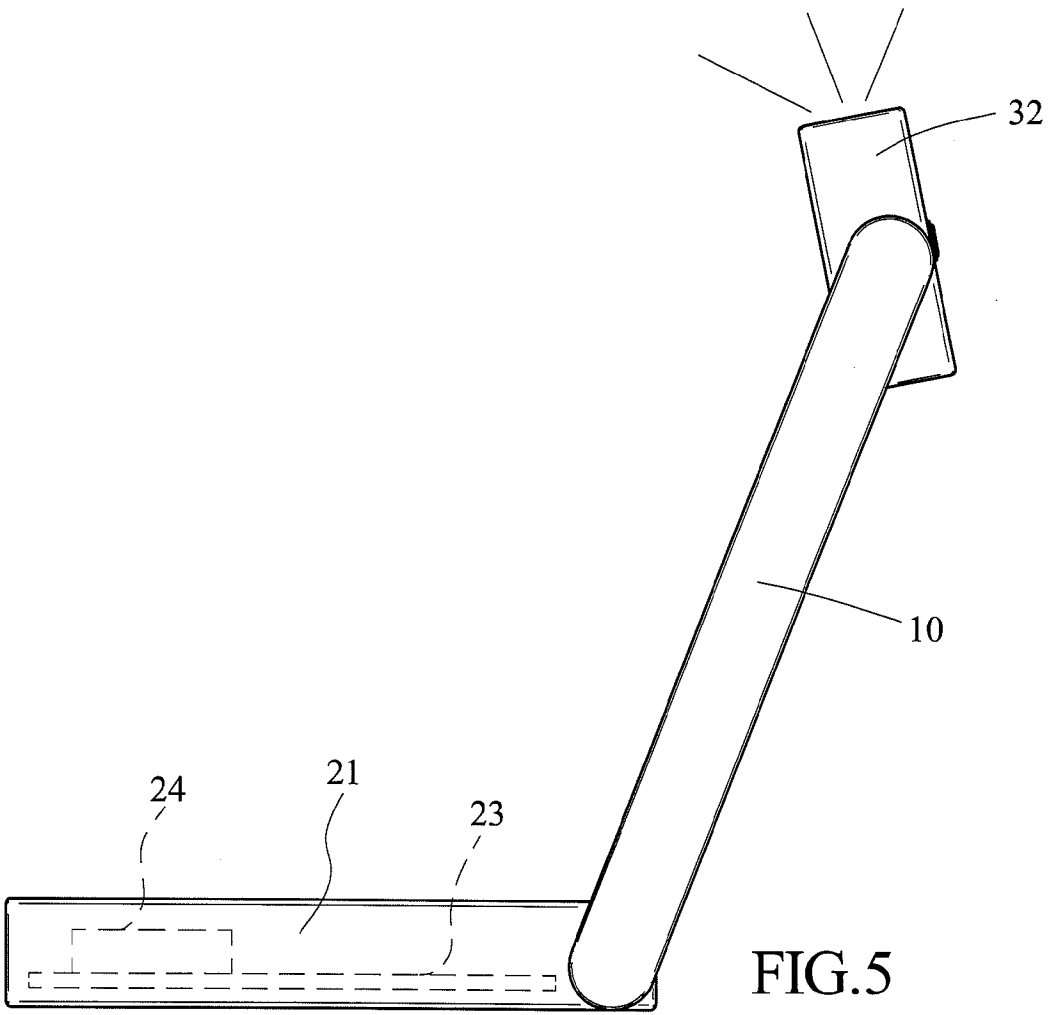
FIGS. 5 and 6 are side views showing the solar illumination device serving as a lamp for meeting according to the invention respectively.
Figure 6:
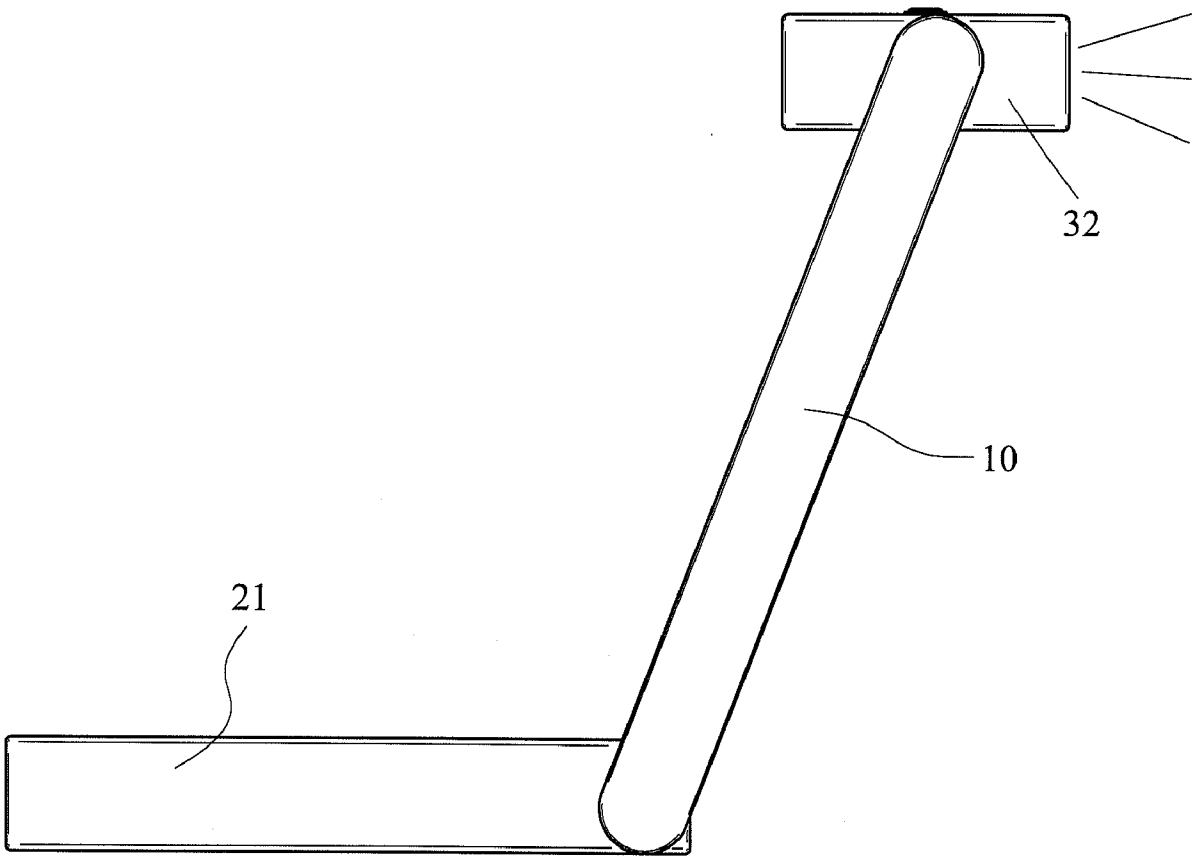
Figure 7:
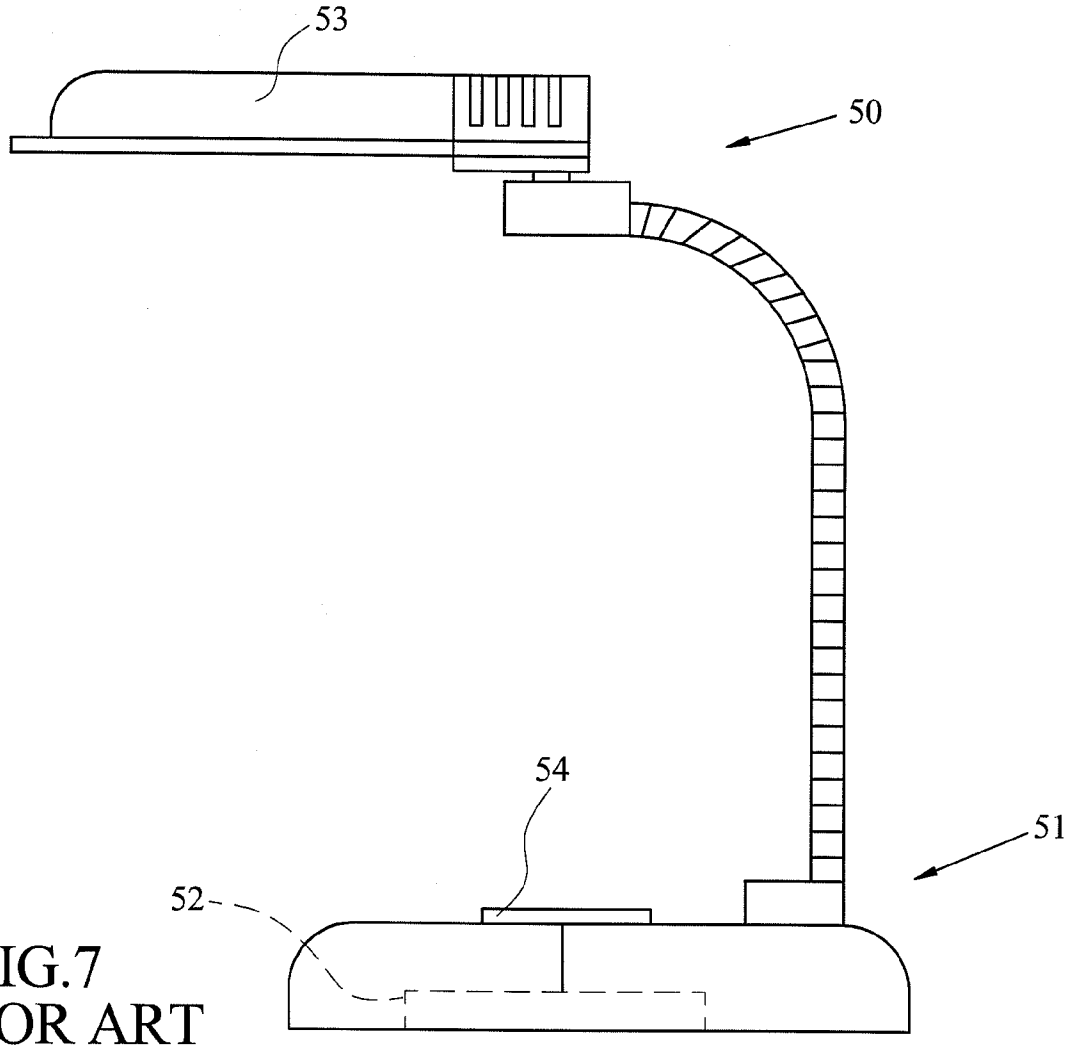
FIG.7 PRIOR ART
FIG. 7 is a side view showing a conventional solar illumination device.

Alternatively, the illumination device can be used as a lamp for meeting by turning the electricity generation and storage assembly 20 about 110 degrees by pivoting the second pivots 13 about the rear end thereof and turning the illumination assembly 30 to an appropriate angle with respect to a desired target (see FIGS. 5 and 6).

Preferably, each of the main body and the housing 32 is made of plastic.

Preferably, the rechargeable battery 24 is a lithium battery.

Preferably, the solar cell panels 22 can absorb not only sunlight but also other light sources for electricity conversion.

While the invention herein disclosed has been described by means of specific embodiments, numerous modifications and variations could be made thereto by those skilled in the art without departing from the scope and spirit of the invention set forth in the claims.

What is claimed is:

1. A solar illumination device comprising:

a pivotal electricity generation and storage assembly comprising a parallelepiped main body having a planar front end, a planar rear end spaced from and parallel to the planar front end, a planar top surface, a planar bottom surface spaced a height and parallel to the planar top surface, a planar first side surface, and a planar second side surface spaced a width from and parallel to the planar first side surface, with the planar top and bottom surfaces extending perpendicularly between the planar front and rear ends and between the planar first and second side surfaces;

at least one solar cell panel mounted on at least one of the planar top and bottom surfaces;

an internal circuit board and a rechargeable battery in the parallelepiped main body, wherein electricity generated by the at least one solar cell panel is supplied to the rechargeable battery for charging via the circuit board, wherein the circuit board controls on or off of the charging of the rechargeable battery;

a pivotal illumination assembly comprising a parallelepiped housing having a front end, a planar rear end spaced from and parallel to the front end, a planar top surface, a planar bottom surface spaced the height and parallel to the planar top surface, a planar first side surface, and a planar second side surface spaced the width from and parallel to the planar first side surface, with the planar top and bottom surfaces extending perpendicularly between the front and rear ends and between the planar first and second side surfaces;

a light source mounted on the front end of the parallelepiped housing;

a switch mounted on the parallelepiped housing, with the switch adapted to manually press to either connect the rechargeable battery to the light source via the circuit board or disconnect the rechargeable battery from the light source via the circuit board; and two planar links each comprising a first pivot pivotably connected about a first axis to a predetermined position of one of first and second side surfaces of the illumination assembly and a second pivot pivotably connected about a second axis to a predetermined position of one of first and second side surfaces of the electricity generation and storage assembly, wherein each link has rectangular cross sections parallel to the first and second axes, with the link having a thickness parallel to the first and second axes which is less than the height, with each link abutting with one of the side surfaces of each of the parallelepiped main body and of the parallelepiped housing;

wherein the front end of the illumination assembly is a recess; wherein the light source is an LED (light-emitting diode) assembly comprising a plurality of LEDs disposed in the recess; wherein the plurality of LEDs are arranged linearly and equidistantly; wherein the predetermined position of the illumination assembly is a midpoint thereof and the predetermined position of the electricity generation and storage assembly is adjacent the rear end thereof; wherein a first length is defined as a distance between each second pivot and the rear end of each side surface of the parallelepiped housing, wherein a second length is defined as a distance between each first pivot and the rear end of the parallelepiped main body, wherein two pivot points of each link are respectively mounted on the first pivot and the second pivot, wherein a distance between the first and second pivots of each link is greater than a total length of the first length plus the second length;

wherein the electricity generation and storage assembly pivots clockwise or counterclockwise about the second pivots freely, and wherein the illumination assembly pivots clockwise or counterclockwise about the first pivots freely.

2. The solar illumination device of claim 1, wherein the parallelepiped main body of the electricity generation and storage assembly and the parallelepiped housing of the illumination assembly are formed of plastic.

3. The solar illumination device of claim 1, wherein the rechargeable battery is a lithium battery.

* * * * *